US007156235B2

(12) United States Patent
Eisinger

(10) Patent No.: US 7,156,235 B2
(45) Date of Patent: Jan. 2, 2007

(54) APPARATUS FOR AND METHOD OF CLASSIFYING PARTICLES DISCHARGED FROM A VERTICAL MILL

(75) Inventor: Frantisek Eisinger, Demarest, NJ (US)

(73) Assignee: Foster Wheeler Energy Corporation, Clinton, NJ (US)

( * ) Notice: Subject to any disclaimer, the term of this patent is extended or adjusted under 35 U.S.C. 154(b) by 190 days.

(21) Appl. No.: 10/786,061

(22) Filed: Feb. 26, 2004

(65) Prior Publication Data

US 2005/0242215 A1 Nov. 3, 2005

(51) Int. Cl.
*B07B 4/00* (2006.01)

(52) U.S. Cl. ..... 209/138; 209/139.1; 209/714

(58) Field of Classification Search ..... 209/138, 209/139.1, 142, 143, 713, 714; 241/79, 80
See application file for complete search history.

(56) References Cited

U.S. PATENT DOCUMENTS

| | | | | |
|---|---|---|---|---|
| 1,146,633 | A * | 7/1915 | Lyons | 209/139.2 |
| 4,597,537 | A * | 7/1986 | Misaka et al. | 241/79.1 |
| 4,750,677 | A * | 6/1988 | Taylor | 241/5 |
| 4,919,341 | A | 4/1990 | Lohnherr | 241/18 |
| 5,251,831 | A | 10/1993 | Yoshida et al. | 241/79.001 |
| 5,624,039 | A * | 4/1997 | Folsberg | 209/714 |
| 5,657,877 | A * | 8/1997 | Yoshida et al. | 209/303 |
| 5,884,776 | A * | 3/1999 | Piepho et al. | 209/714 |
| 5,976,224 | A * | 11/1999 | Durant et al. | 95/268 |
| 6,827,221 | B1 * | 12/2004 | Brundiek et al. | 209/210 |

FOREIGN PATENT DOCUMENTS

| | | |
|---|---|---|
| GB | 1 280 062 | 7/1972 |

* cited by examiner

*Primary Examiner*—Joseph C. Rodriguez
(74) *Attorney, Agent, or Firm*—Fitzpatrick, Cella, Harper & Scinto

(57) ABSTRACT

A classifier for separating coarse particles from a stream of gas and particles discharged from a vertical mill. The classifier includes a generally cylindrical outer casing having a vertical axis and a vertically oriented sidewall disposed on the mill, an inner casing arranged within the outer casing, providing an annular passageway between the inner casing and the sidewall through which the stream of gas and particles flows upwardly, a ring, supported about the axis, including a plurality of circumferentially-spaced static vanes forming angled ports for imparting rotational motion to the stream of gas and particles flowing through the ports for centrifugally separating a first portion of coarse particles, thereby producing a remaining stream of gas and particles, a wheel, supported for rotation about the vertical axis, including a plurality of circumferentially-spaced radially extending blades, and a passageway for guiding the remaining stream of gas and particles inside the wheel for allowing the remaining stream to flow radially outwardly through openings formed between the blocks, so as to accelerate the rotational motion of the remaining stream for separating a second portion of coarse particles, thereby producing a final stream of gas and particles to be discharged from the classifier. The first portion of coarse particles and the second portion of coarse particles are discharged from the classifier through an outlet for separated particles.

15 Claims, 4 Drawing Sheets

APPARATUS FOR AND METHOD OF CLASSIFYING PARTICLES DISCHARGED FROM A VERTICAL MILL

BACKGROUND OF THE INVENTION

1. Field of the Invention

The present invention relates to an apparatus for and a method of separating coarse particles from a stream of gas and a mixture of coarse and fine particles discharged from a vertical mill. More particularly, this invention relates to a dynamic particle classifier for aerodynamic separation of coarse particles from a stream of gas and particles discharged from a vertical mill, and a separating method for a dynamic particle classifier.

2. Description of the Related Art

A dynamic particle classifier generally includes a rotating wheel of vanes. The purpose of such a particle classifier is to remove oversized particles from an original stream (for example, a stream of gas) without removing too many fine particles. The sharpness of the particle size distribution in the outlet stream of a dynamic classifier is usually increased by combining a set of static vanes and a set of rotating vanes in the classifier.

A particle classifier is often used in combination with a vertical mill, such as a coal mill or a cement mill, which grinds coarse raw material to small particles. In this arrangement, a stream of gas and particles is discharged from the mill to the classifier, which separates the coarsest fraction of the particles from the stream and returns the separated particles to the mill for re-grinding.

In a conventional dynamic classifier, such as disclosed, e.g., in U.S. Pat. No. 4,919,341, a stream of gas and particles discharged from a coal mill is first imparted in rotation by static vanes and then directed from outside to a rotating wheel of vanes. Gas and fine particles pass through the rotating vanes to a central volume, and flow upwards to exit the classifier through an outlet opening. Larger particles attempting to move through the rotating vanes will be thrown back and drop through a central outlet opening of the classifier back to a mill.

A disadvantage of the conventional dynamic classifier design is that an incoming stream enters the rotating wheel radially inwardly and a flow of separated coarse particles is directed from the wheel outward at the same time. These opposing flows lead to a collision of the streams, resulting in an increased resistance to the flow of gas. The flow of gas through the classifier must overcome the resistance of the opposing flow, resulting in an increased pressure loss in the classifier.

In a classifier combined with a vertical mill, the separated coarse particles are directed, together with fresh raw material, to the center of the mill. The material is usually ground in the mill by rollers on a rotating plate, while the material moves from the center of the plate toward its peripheral edge. At the edge of the rotating plate, the ground material is conveyed up to the classifier, as explained above, by a stream of gas.

The radially extending vanes of the rotating wheel usually form a vertical cylinder or a downward tapering cone. U.S. Pat. No. 5,251,831 discloses a dynamic classifier, in which the rotating wheel forms a downward tapering cone, and each rotating vane is downwardly inclined, i.e., designed such that its lower portion is trailing with respect to its upper portion. Thereby, the rotating wheel does not change the direction of the separated particles completely opposite to the incoming flow, but partly downwards, toward the central outlet opening of the inner cone. Thus, the flow of separated particles is not opposing, but merely traversing, the incoming flow. This reduces the pressure loss to some extent compared to that in a conventional dynamic classifier.

British patent publication GB 1,280,062 discloses a classifier in which the centrifugal classification by static vanes is aided by providing a vertically-oriented axial fan at the upper portion of the classification space. A flow of coarse particles, separated by the axial fan, crosses the stream of gas and particles flowing through the static vanes, and tends to be mixed with it.

All of the above-described classifier designs involve interference between different streams, and thus, tend to suffer from increased pressure losses and reduced classifying efficiency.

SUMMARY OF THE INVENTION

An object of the present invention is to provide a new apparatus and method for efficient classification of coarse and fine particles in a gas stream.

Another object of the present invention is to provide a new method and design for a dynamic classifier, which reduces the pressure losses in the classifier.

In order to achieve these and other objects of the present invention, a new apparatus and method for separating coarse particles from a stream of gas and a mixture of coarse and fine particles are provided, as described in the appended claims.

Especially, according to the present invention, a classifier for separating coarse particles from a stream of gas and particles discharged from a vertical mill is provided. The classifier includes a generally cylindrical outer casing, an inner casing, a ring, and a wheel. The outer casing has a vertical axis and a vertically-oriented sidewall disposed on the mill. The inner casing is arranged within the outer casing, providing an annular passageway between the inner casing and the sidewall through which the stream of gas and particles flows upwardly. The ring is supported about the axis and comprises a plurality of circumferentially-spaced static vanes forming angled ports for imparting rotational motion to the stream of gas and particles flowing through the ports toward the inner casing for centrifugally separating a portion of coarse particles, thereby producing a remaining stream of gas and particles. The wheel is supported for rotation about the axis and comprises a plurality of circumferentially-spaced, radially extending, blades for accelerating the rotational motion of the remaining stream for centrifugally separating another portion of coarse particles, thereby producing a final stream of gas and particles, to be discharged from the classifier. The portion of coarse particles and the other portion of coarse particles are discharged from the classifier through an outlet for separated particles.

Additionally, according to another embodiment, the present invention provides a method of separating coarse particles from a stream of gas and particles discharged from a vertical mill. The method includes the following steps. In step (a), the stream of gas and particles is passed upwardly through an annular passageway formed between an inner casing and a vertically extending sidewall of an outer casing having a vertical axis and being disposed on the mill. In step (b), the stream of gas and particles is guided toward the inner casing through angled ports formed between a plurality of circumferentially-spaced static vanes in a ring supported about the axis to impart rotational motion to the stream of gas and particles for centrifugally separating a portion of coarse particles, thereby producing a remaining stream of gas and particles. In step (c), the remaining stream is guided inside a wheel supported for rotation about the axis, the wheel comprising a plurality of circumferentially-spaced radially extending blades. In step (d), the remaining stream is guided radially outwardly through openings formed between the radially extending blades to accelerate the rotational motion of the remaining stream for separation of another portion of coarse particles therefrom, thereby producing a final stream of gas and particles. The portion of coarse particles and the other portion of coarse particles are discharged through an outlet for separated particles.

According to the present invention, a dynamic classifier and a method in a dynamic classifier are provided in which the flow of gas through the rotating wheel of blades is one-directional. As such, the classifier does not include a flow of gas and particles entering a rotating wheel and colliding with a stream of separated particles thrown back by the blades. Instead, according to the present invention, the rotating wheel of blades increases the rotating speed of a stream of gas and particles flowing in its entirety outward through the blades, and thus, enhances the centrifugal separation of particles.

A classifier according to the present invention can be combined with different kinds of mills, especially with all types of vertical spindle mills and other mill types that utilize the aerodynamical classifiers commonly found on vertical spindle mills. An example of vertical spindle mills is a roller mill used for grinding coal to be used as a fuel in a-pulverized coal burning (PC-) boiler. In order to achieve high combustion efficiency in a PC-boiler, it is very important to use a classifier to effectively separate oversized coal particles from the fuel stream conveyed from the coal mill to the coal burners in the boiler.

Usually, the ring comprising static vanes is supported between the outer and inner casings, and the ports imparting rotational motion to the stream of gas and particles entering into the inner casing are mainly horizontal. In this design, advantageously, a set of vertically extending ports is also arranged on the ring, for guiding a stream of gas and/or particles. The stream flowing through the vertical ports may be, depending on the design of the classifier, as will be explained below, either a portion of coarse particles falling downward or the final stream of gas and particles flowing upward.

According to an advantageous embodiment of the present invention, the wheel supported for rotation is disposed at a higher level than the ring comprising circumferentially spaced static vanes. When using this design, it is a major concern to guide the portion of coarse particles separated downstream from the rotating wheel of blades back to the mill for re-grinding without interfering with the flow of gas and particles entering the classifier.

In order to avoid the interference, the ring comprising static vanes advantageously comprises vertically extending ports through which the other portion of coarse particles can flow downward to the mill. Thus, the inward flowing stream of gas and particles and downward flowing stream of separated particles cross each other in separate channels, and do not collide with each other. The resistance of the gas through the classifier is then mainly determined by the geometry of the channels, and not by a high turbulence due to colliding streams.

The lower ends of the vertically extending ports in the ring of static vanes are advantageously within the inner casing of the classifier, so as to allow the portion of coarse particles separated downstream of the wheel of rotating blades to flow through the vertical ports into the inner casing. Thus, the two streams of separated particles combine in the inner casing, from where they can be conducted through a central outlet opening in the bottom of the inner casing back to the mill for re-grinding.

In some designs, it may be advantageous to dispose the rotating wheel of blades at a lower level than the ring of static vanes. In such a design, the separated coarse particles can freely fall toward their outlet opening, while there is no crossing between the incoming stream and separated particles. However, in this design, there is a need to guide the final stream of gas and fine particles upward without interfering with the incoming stream of gas and particles. Advantageously, the final stream is then guided upward via vertical ports arranged in the ring of static vanes to be discharged from the classifier through one or more outlet openings.

The blades in the rotating wheel may be mainly vertical and form a generally cylindrical shape. However, in some designs, the blades may form a generally conical shape. Especially, if the rotating wheel is disposed at a lower level than the ring of static vanes, it may be advantageous that the blades are arranged in a downward tapering conical shape.

The rotating wheel enhances the centrifugal separation of coarse particles by accelerating the rotational speed of the stream of gas and particles. Thus, the wheel is rotated in the same direction as the rotational motion of the stream of gas and particles as imparted by the static vanes. Usually, the blades of the rotating wheel are directed radially from the axis of the wheel. The circumferential speed of the rotating blades is typically on the order of about 1500 to about 1800 m/min, corresponding to a radial acceleration in excess of at least 50 g.

Varying the rotational speed of the rotating wheel can control the fineness of the particles of the final stream discharged from the classifier. The higher the rotational speed, the higher is the acceleration imposed upon the particles, and correspondingly smaller particles are separated from the stream. It may also be possible to control the fineness of the particles, and even the sharpness of the particle size distribution, by adjusting the angle of the static vanes.

Typically, the velocity of the gas carrying particles from the mill to the classifier is such that coarsest particles are separated from the stream of gas and particles already upstream of the inner casing of the classifier. The passageway for the stream of gas and particles from the mill to the inner casing of the classifier may comprise static vanes, which bring about a pre-rotation of the stream, and enhance the separation of coarse particles from the stream. Pre-rotation can also be caused by using directional nozzles for injecting the gas toward the classifier at the outer perimeter of the mill.

BRIEF DESCRIPTION OF THE DRAWINGS

The above brief description, as well as further objects, features and advantages of the present invention will be more fully appreciated by reference to the following detailed description of the currently preferred, but nonetheless illustrative, embodiments in accordance with the present invention, when taken in conjunction with the accompanying drawings, wherein.

DETAILED DESCRIPTION OF THE PREFERRED EMBODIMENTS

Figure 1:
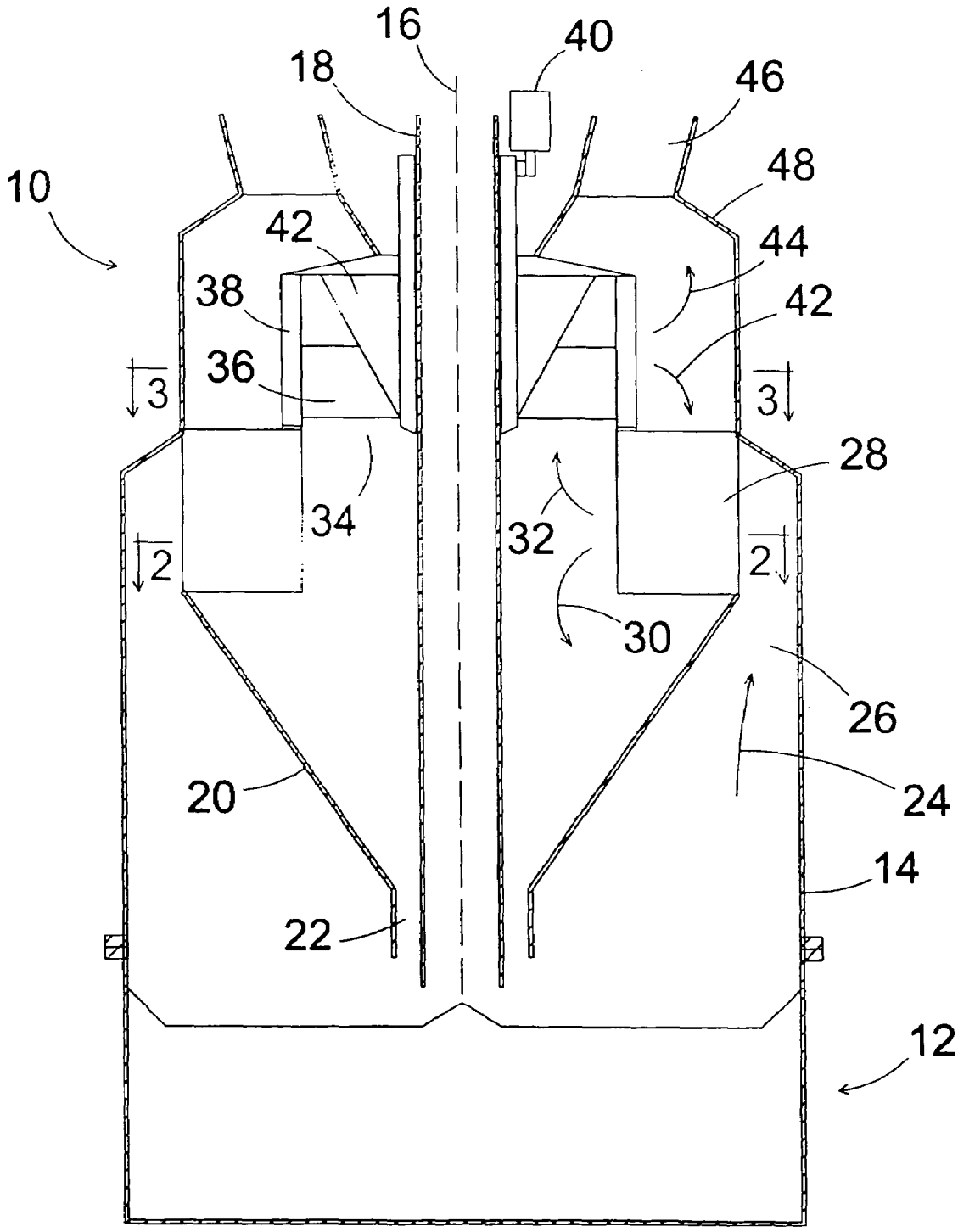
FIG. 1 is a schematic, vertical cross-sectional view of a classifier according to a first embodiment of the present invention.

FIG. 1 shows schematically a classifier 10 connected with a vertical spindle mill 12. The classifier 10 comprises a generally cylindrical outer casing 14 having a vertical axis 16. At the axis 16 is usually arranged a feed tube 18 for guiding raw material to the center of the mill 12 to be ground while the raw material travels toward the outer edge of the mill 12.

Within the outer casing 14 is arranged a conical inner casing 20, which has a central outlet opening 22 at its bottom for discharging separated coarse particles from the classifier 10 to the mill 12 for re-grinding. The outlet opening 22 may comprise a flap construction (not shown) to prevent gas from flowing through the opening 22 upwards into the inner casing 20.

An annular stream of gas and particles 24 flows upwardly from the mill 12 through a passageway 26 formed between the outer casing 14 and the inner casing 20. The stream 24 is directed into the inner casing 20 through ports formed by a ring 28 comprising a set of angled static vanes disposed between the outer casing 14 and the inner casing 20. The set of circumferentially spaced static vanes, which will be described more closely in connection with FIG. 2, will impart rotational motion to the stream 24 so as to centrifugally separate a portion of coarse particles 30 from a remaining stream of gas and particles 32.

The separated coarse particles 30 fall through the opening 22 of the inner casing 20 to the mill 12 for re-grinding. The remaining stream of gas and particles 32 is guided via an annular passageway 34 to an annular inner volume 36 of a cylindrical wheel 38, which is rotated about the axis 16 by means of a motor 40. The inner volume 36 may comprise a conical insert 42, which directs the stream 32 outwardly.

The wheel 38 is rotated in the direction of the rotation of stream 32 caused by the static vanes in the ring 28, as will be described in more detail in connection with FIG. 3. When the stream of gas and particles 32 flows through openings formed by radially extending blades in the wheel 38, the whirling of the stream 32 is accelerated, and a further portion of coarse particles 42 is centrifugally separated, such that a final stream of gas and fine particles 44 is produced. The separated coarse particles 42 are allowed to fall through vertical ports formed in the ring of static vanes 28, to be described in more detail in connection with FIG. 2.

The stream of gas and fine particles 44 is discharged from the classifier 10 through one or more outlet openings 46 at an upper head 48 of the classifier 10. When the classifier 10 is connected to a coal mill 12 of a PC-boiler, the stream of gas in the classifier is usually primary combustion air, and the fine coal particles are pneumatically conveyed from the classifier to the burners of the boiler (not shown) by the primary combustion air.

Figure 2:
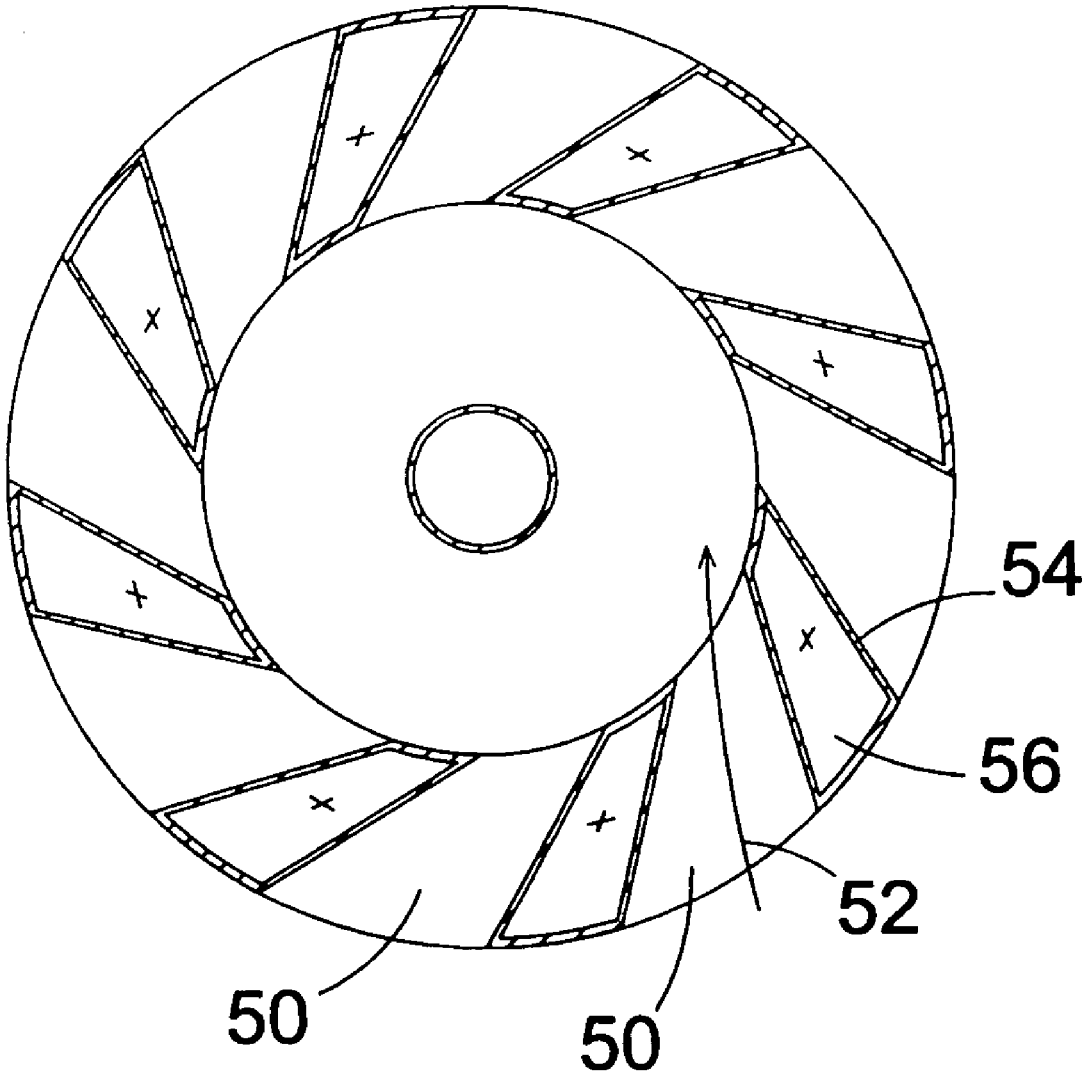
FIG. 2 is a schematic, horizontal cross-sectional view taken along line 2—2 of FIG. 1.

FIG. 2 depicts a horizontal cross section of the classifier 10 on the level of the static vanes, i.e., along line 2—2 of FIG. 1. FIG. 2 shows multiple horizontally extending ports 50, through which an annular stream of gas and particles 52 flows into the inner casing 20. See FIG. 1. The horizontal ports 50 are formed by angled hollow vanes 54. Within the hollow vanes 54 are formed vertical ports 56, through which a stream of separated coarse particles, 42 in FIG. 1, can fall to the lower part of the inner casing 20. The number of vanes 54 in FIG. 2 is eight, but it can also be smaller or larger, for example from six to twenty.

Figure 3:
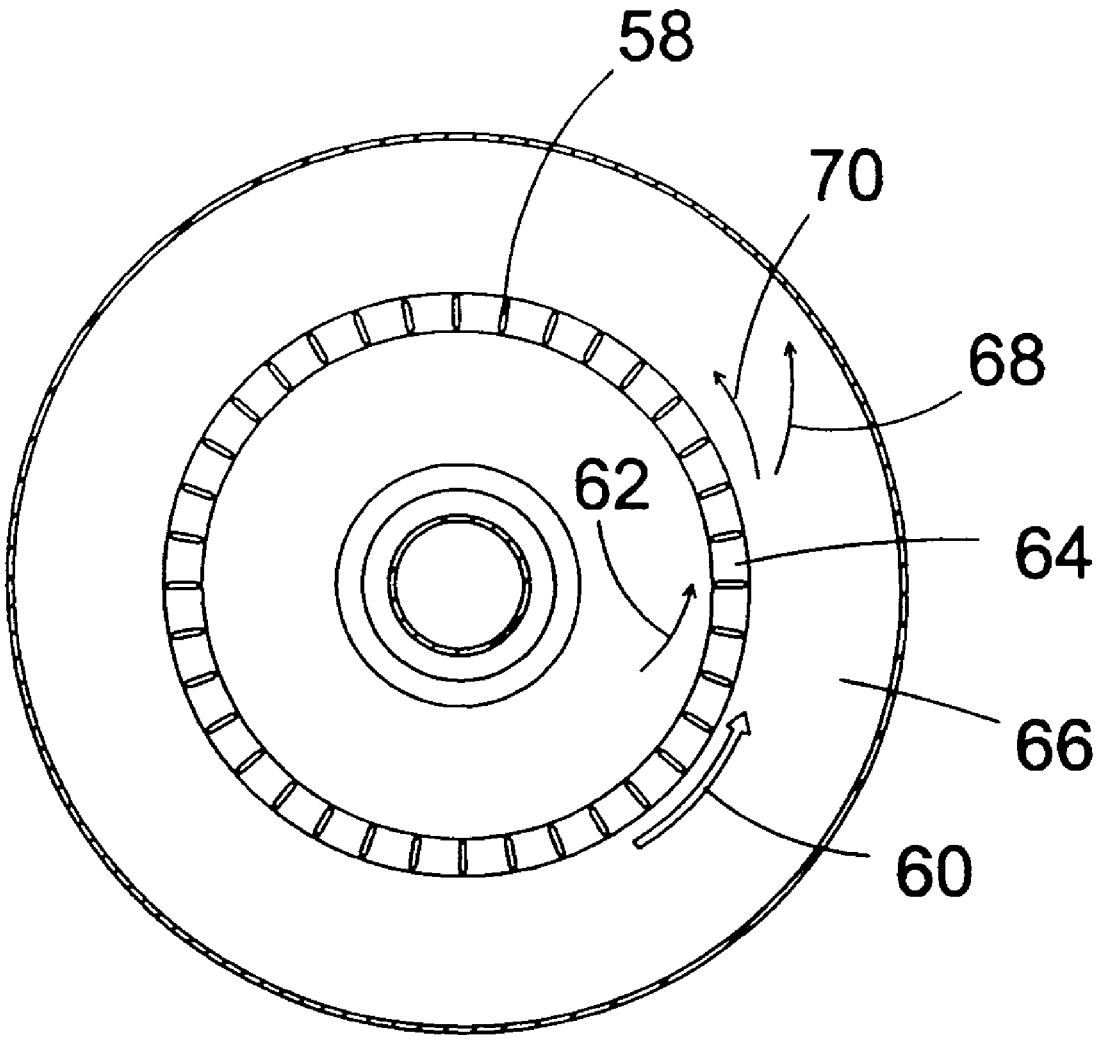
FIG. 3 is a schematic, horizontal cross-sectional view taken along line 3—3 of FIG. 1.

FIG. 3 shows a horizontal cross section of the classifier 10 on the level of the rotating blades 58, i.e., along line 3—3 of FIG. 1. Arrow 60 shows the direction of rotation of the rotating wheel of blades 38. The speed of rotation of the wheel 38 is higher than the rotational speed of the stream of gas and particles 62 within the inner volume of the wheel 38. Thus, when a pressure difference drives the stream 62 through the openings 64 formed between the blades 58, the rotation of the blades accelerates the rotation of the stream 62.

When the stream enters the outer volume 66, enhanced centrifugal forces separate further coarse particles 68, and a final stream of gas and fine particles 70 is produced. The gas pneumatically conveys the classified fine particles upwards and through an outlet opening of gas and fine particles from the classifier. The separated coarse particles are allowed to fall back to the mill for re-grinding.

Figure 4:
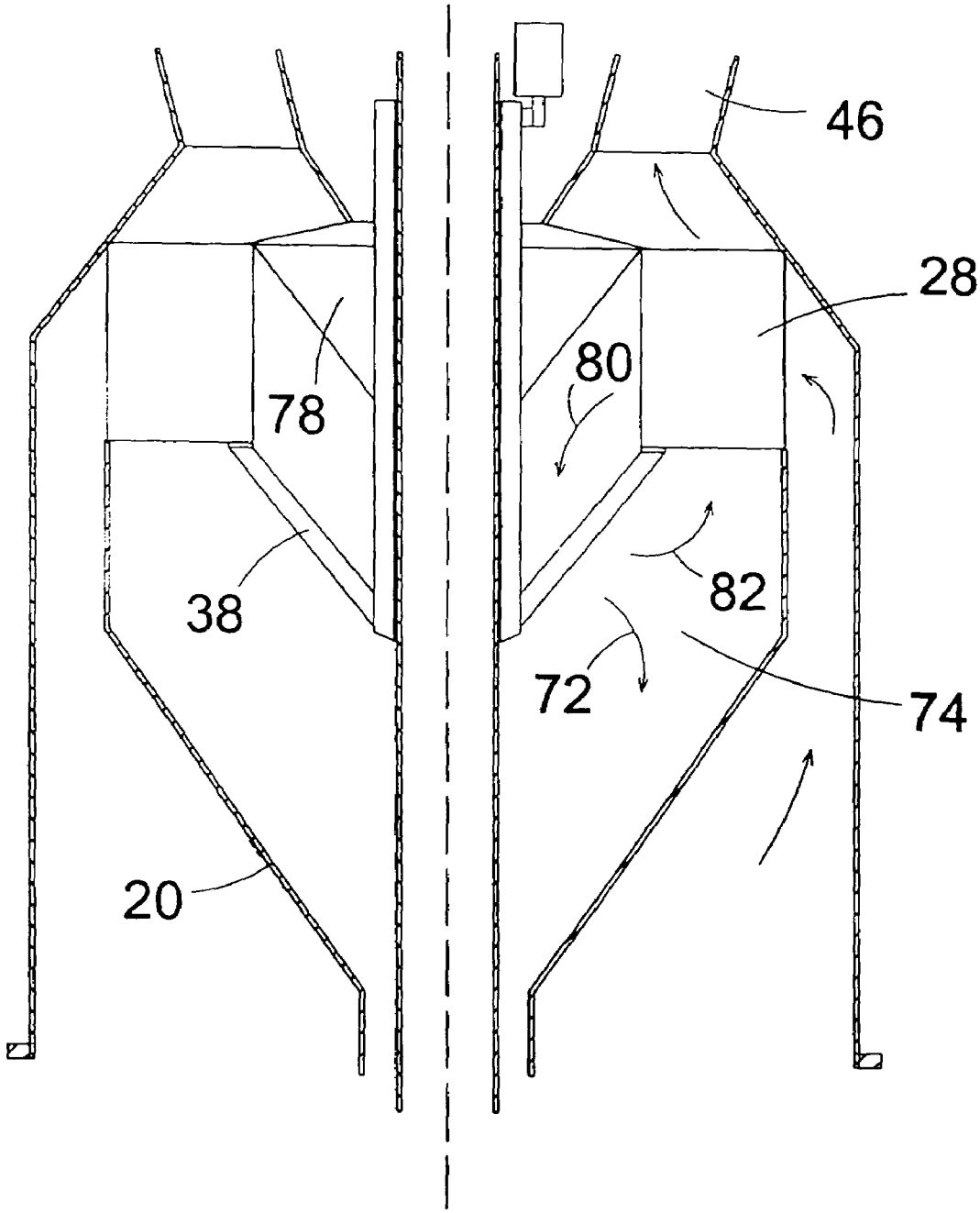
FIG. 4 is a schematic, vertical cross-sectional view of a classifier according to a second embodiment of the present invention.

FIG. 4 shows another embodiment of the present invention, which differs from that shown in FIG. 1 in that the rotating wheel of blades 38 is arranged at a lower level than the ring of static vanes 28. Thus, most of the separation of coarse particles 72 from the stream of gas and particles takes place in the lower portion 74 of the inner casing 20. Coarse particles are separated centrifugally due to enhanced whirling of the stream, and by simultaneously turning the stream from a downward direction to an upward direction within the inner casing 20.

In the design of FIG. 4, the rotating wheel of blades 38 may be cylindrical, as shown in FIG. 1, or conical, as shown in FIG. 4. In FIG. 4, there is a conical insert 78 inside the ring 28 of static vanes, to smoothly turn the flow 80 downward within the rotating wheel 38. If the wheel 38 is cylindrical, i.e., if the stream of gas and particles exits the wheel mainly horizontally, the rotating wheel may advantageously comprise another conical insert also at the bottom of the wheel, so as to smoothly turn the flow horizontal.

In the embodiment of FIG. 4, the produced final stream of gas and fine particles 82 has to be guided up to the outlet openings 46 without mixing with the stream entering the inner casing 20. Advantageously, this is achieved by arranging vertical ports in the ring of static vanes 28, as shown in FIG. 2, and guiding the stream 82 through these vertical ports.

An objective of the classifiers designed according to the present invention is to reduce pressure losses by avoiding collisions of opposing streams at the openings of the rotating wheel. In the representative embodiments described herein, the gas stream is one-directional, i.e., it flows through the classifier without colliding with another stream. This is achieved by guiding a stream of gas and particles through the rotating wheel outward, so as to accelerate the rotation of the stream. Thus, the final separation takes place by accelerating the whirling of the stream, not by preventing a portion of the stream from entering the wheel, as in previous dynamic classifiers.

In the designs of FIGS. 1 and 4, the set of static vanes comprises horizontal ports for the incoming stream and vertical ports for a particular fraction produced in the final separation. In the design of FIG. 1, the particular fraction flowing through the vertical ports is a downward stream of coarse particles, whereas in the design of FIG. 4, the particular fraction is an upward stream of gas and fine particles. By using any of these constructions, it is possible to avoid the particular fraction from interfering with the incoming stream.

While the invention has been described herein by way of examples in connection with what are at present considered to be the most preferred embodiments, it is to be understood that the invention is not limited to the disclosed embodiments, but is intended to cover various combinations or modifications of its features and several other applications included within the scope of the invention as defined in the appended claims.

As an example, it is not necessary to combine a cross-over part, for undisturbing crossing of the incoming stream and a fraction of the final separation product, with the static vanes. Instead, the static vanes for creating a rotational motion to the stream of gas and particles may be separate, being disposed, e.g., in the passageway 26, or at the exit of gas from the mill 12. In some designs, it may even be possible to replace the static vanes by using directional nozzles of gas in the mill 12.

We claim:

1. A classifier for separating coarse particles from a stream of gas and particles discharged from a vertical mill, the classifier comprising:

a generally cylindrical outer casing having a vertical axis and a vertically oriented sidewall disposed on the mill;

an inner casing arranged within said outer casing, providing an annular passageway between said inner casing and said sidewall through which the stream of gas and particles flows upwardly;

a ring, supported about the axis, comprising a plurality of circumferentially-spaced static vanes forming angled ports for imparting rotational motion to the stream of gas and particles flowing through the ports for centrifugally separating a first portion of coarse particles, thereby producing a remaining stream of gas and particles;

a wheel, supported for rotation about the vertical axis, comprising a plurality of circumferentially-spaced radially extending blades; and a passageway for guiding the remaining stream of gas and particles inside the wheel for allowing the remaining stream to flow radially outwardly through openings formed between the blades, so as to accelerate the rotational motion of the remaining stream for separating a second portion of coarse particles, thereby producing a final stream of gas and particles to be discharged from the classifier, wherein the first portion of coarse particles and the second portion of coarse particles are discharged from the classifier through an outlet for separated particles.

2. The classifier according to claim 1, wherein said ring is supported between said outer casing and said inner casing.

3. The classifier according to claim 2, wherein said ports for imparting rotational motion are horizontally extending.

4. The classifier according to claim 3, said ring further including vertically extending ports.

5. The classifier according to claim 4, wherein said wheel is disposed at a higher level than said ring and the second portion of coarse particles falls downwardly through said vertically extending ports.

6. The classifier according to claim 4, wherein said wheel is disposed at a lower level than said ring and the final stream flows upwardly through said vertically extending ports.

7. The classifier according to claim 5, wherein lower ends of said vertically extending ports are within the inner casing such that the second portion of coarse particles falls through the ports into said inner casing.

8. The classifier according to claim 1, wherein said radially extending blades are vertical and form a generally cylindrical shape.

9. The classifier according to claim 6, wherein said radially extending blades are downward-inclined and form a generally conical shape.

10. The classifier according to claim 1, wherein said wheel rotates in the direction of the rotational motion of the stream of gas and particles, as imparted by the static vanes.

11. A method of separating coarse particles from a stream of gas and particles discharged from a vertical mill, the method comprising the steps of:

(a) passing the stream of gas and particles upwardly through an annular passageway formed between an inner casing and a vertically extending sidewall of an outer casing having a vertical axis and being disposed on the mill;

(b) guiding the stream of gas and particles toward the inner casing through angled ports formed between a plurality of circumferentially-spaced static vanes in a ring supported about the axis to impart rotational motion to the stream for centrifugally separating a first portion of coarse particles, thereby forming a remaining stream of gas and particles;

(c) guiding the remaining stream inside a wheel supported for rotation about the axis, the wheel comprising a plurality of circumferentially spaced radially extending the blades; and (d) guiding the remaining stream radially outwardly through openings formed between the radially extending blades to accelerate the rotational motion of the remaining stream for separation of a second portion of coarse particles therefrom, thereby producing a final stream of gas and particles, wherein the first portion of coarse particles and the second portion of coarse particles are discharged through an outlet for separated particles.

12. The method according to claim 11, comprising the further step of:

(e) guiding one of the second portion of coarse particles and the final stream through vertically extending ports formed in the ring.

13. The method according to claim 12, wherein in step (c) the remaining stream is guided upwardly inside the wheel, and in step (e) the second portion of coarse particles is allowed to fall to the inner casing through the vertically extending ports.

14. The method according to claim 12, wherein in step (c) the remaining stream is guided downwardly inside the wheel, and in step (e) the final stream flows upwardly through the vertically extending ports.

15. The method according to claim 11, wherein the wheel rotates in the direction of the rotational motion of the stream of gas and particles, as imparted by the static vanes.

* * * * *